US005622052A

United States Patent [19]

Fähnle et al.

[11] Patent Number: 5,622,052

[45] Date of Patent: Apr. 22, 1997

[54] DOUBLE-FLOW HYDROSTATIC RADIAL PISTON ENGINE WITH AXIAL FLOW, THRUST COMPENSATION, AND SHAFT BEARING

[75] Inventors: Gerhard Fähnle; Günther Nagel, both of Steinheim, Germany

[73] Assignee: J.M. Voith GmbH, Heidenheim, Germany

[21] Appl. No.: 325,809

[22] Filed: Oct. 19, 1994

[30] Foreign Application Priority Data

Oct. 19, 1993 [DE] Germany ..... 43 35 513.7

[51] Int. Cl.[6] ..... F16D 39/00; F01B 13/06

[52] U.S. Cl. ..... 60/487; 92/12.1; 92/58; 92/77

[58] Field of Search ..... 60/483, 487, 490; 92/12.1, 58, 72; 417/273

[56] References Cited

U.S. PATENT DOCUMENTS

| | | | |
|---|---|---|---|
| 2,226,481 | 12/1940 | Rose | 60/487 |
| 2,818,707 | 1/1958 | Sturm | 60/490 |
| 3,961,562 | 6/1976 | Kersten et al. | 91/492 |
| 4,033,239 | 7/1977 | Gsching | 92/58 |
| 4,686,829 | 8/1987 | Thoma et al. | 60/487 X |
| 4,691,512 | 9/1987 | Thoma et al. | 60/487 X |
| 5,042,252 | 8/1991 | Havens et al. | 60/490 X |
| 5,374,165 | 12/1994 | Fahnle | 92/58 X |
| 5,400,594 | 3/1995 | Hayens | 92/12.1 X |

FOREIGN PATENT DOCUMENTS

| | | |
|---|---|---|
| 345103 | 8/1978 | Austria . |
| 83300 | 7/1971 | Germany . |
| 2301448 | 7/1974 | Germany . |
| 9208850 | 10/1992 | Germany . |
| 4123675 | 1/1993 | Germany . |

*Primary Examiner*—Edward K. Look
*Assistant Examiner*—Hoang Nguyen
*Attorney, Agent, or Firm*—Marshall, O'Toole, Gerstein, Murray & Borun

[57] ABSTRACT

A hydrostatic radial piston engine with two rotors that are supported on an axle so that they can rotate easily thereon. The rotors have a plurality of radial bores with displacement elements (pistons with slide ring) therein, sliding on the inside of a piston ring. The bores are connected via control slits with transport channels (high-pressure/low-pressure) that open on a side on the rotors for the purpose of controlling the transport of the pressure medium. The two rotors can be rotated easily on the axle which mounted on an intermediate bottom. The intermediate bottom is disposed between the rotors. Check plates are disposed on the ends of the axle which take up the axial forces produced by the pressure medium in the control slits of the rotors. The piston rings are supported in the intermediate bottom by a common connecting shaft.

7 Claims, 11 Drawing Sheets

DOUBLE-FLOW HYDROSTATIC RADIAL PISTON ENGINE WITH AXIAL FLOW, THRUST COMPENSATION, AND SHAFT BEARING

BACKGROUND OF THE INVENTION

1. Field of the Invention

The invention relates to hydrostatic radial piston engines and in particular to such engines having two rotors supported on an axle with each rotor having a plurality of radial bores flow connected via control slits to transport channels that open on a side of the rotor.

2. Description of Related Technology

Double-flow radial piston engines designed to provide a system of axial thrust compensation and having two rotors are known. In such engines the two rotors are disposed on a shaft and rotate therewith in unison. Fundamentally, one could construct a hydrostatic pump as well as a hydrostatic motor based on such a configuration.

SUMMARY OF THE INVENTION

It is an object of the invention to provide a hydrostatic radial piston engine of the generic type in which axial forces can be compensated for on the axle of the engine. Based on such a system, it should be possible to provide a hydrostatic pump with one or two flows, a corresponding hydrostatic motor and a hydrostatic drive.

According to the invention, a hydrostatic radial piston engine comprises two rotors supported by and readily rotatable on an axle. Each rotor has a plurality of radial bores. Displacement elements disposed in the bores comprise a piston with a slide ring. The displacement element slides on an inside of a piston ring. The bores are connected via control slits with high-pressure/low-pressure transport channels that open on a side of the rotor. According to the invention, the supporting axle is mounted in an intermediate bottom disposed between the rotors. The engine further includes check plates disposed on the ends of the axle. The check plates take up the axial forces produced by a pressure medium in the control slits of the rotors. The piston rings are supported in the intermediate bottom by a common connecting shaft.

Advantages of the invention include the fact that axial as well as radial forces are taken up inside a radial piston engine, so that no noise is given off or radiated through respective outside surfaces of the engine.

Other objects and advantages of the invention will be apparent to those skilled in the art from the following detailed description taken in conjunction with the drawings and the appended claims.

DETAILED DESCRIPTION OF THE INVENTION

Figure 7:
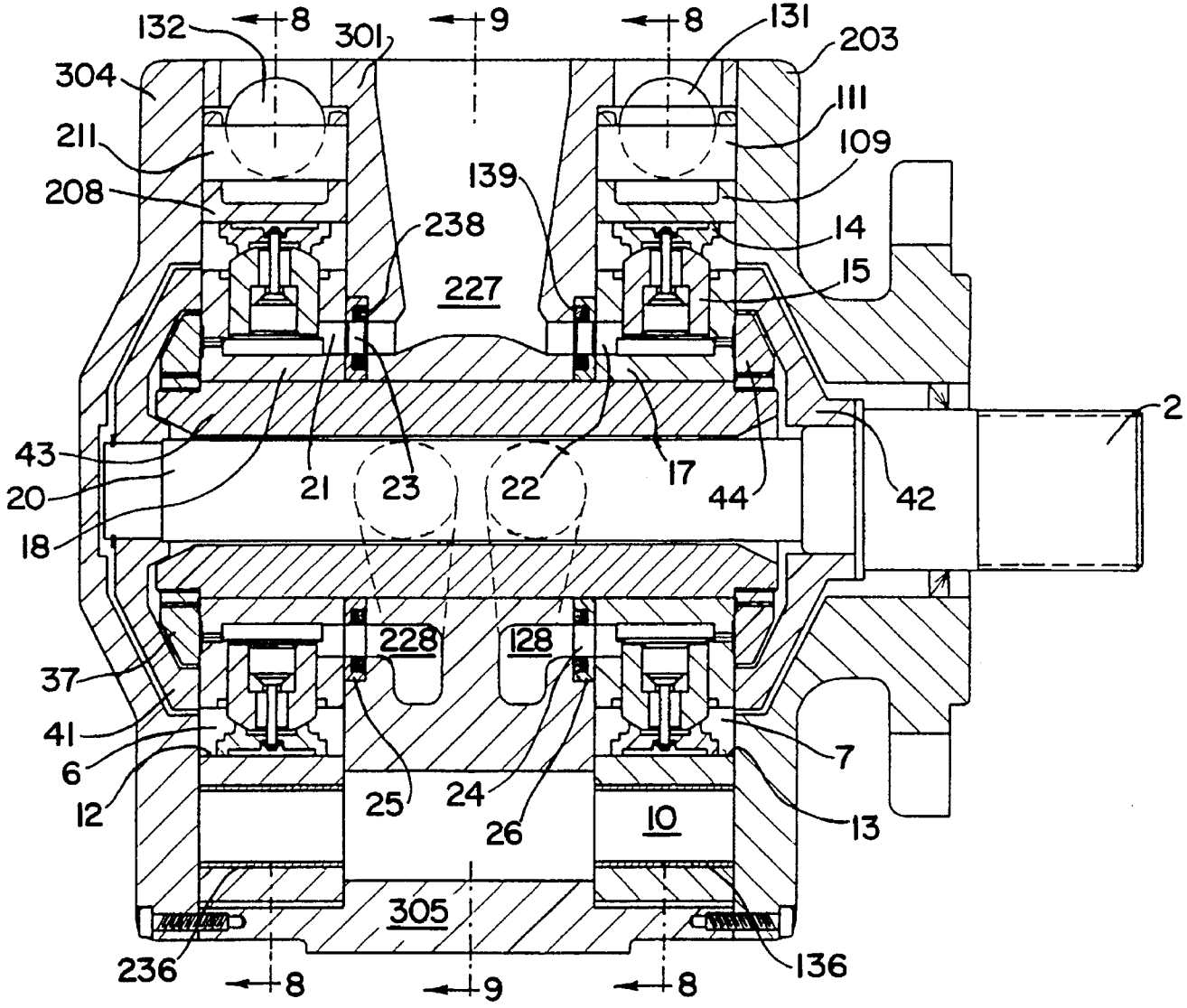
FIG. 7 is a longitudinal sectional view of a third embodiment of a hydrostatic engine (double-flow pump and double-flow motor) according to the invention.
Figure 8:
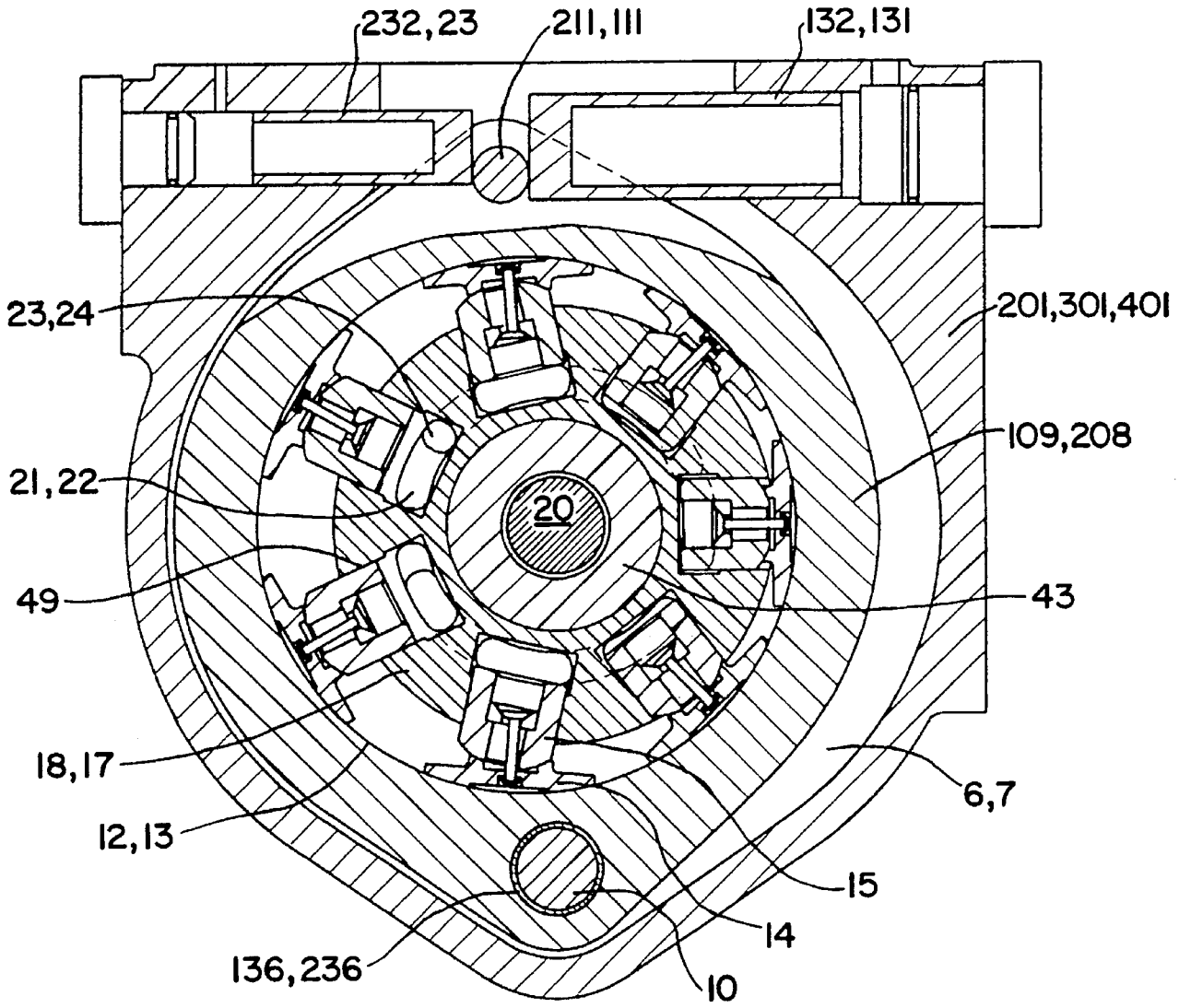
FIG. 8 is a cross-sectional view taken along the line VIII—VIII of FIG. 7.
Figure 9:
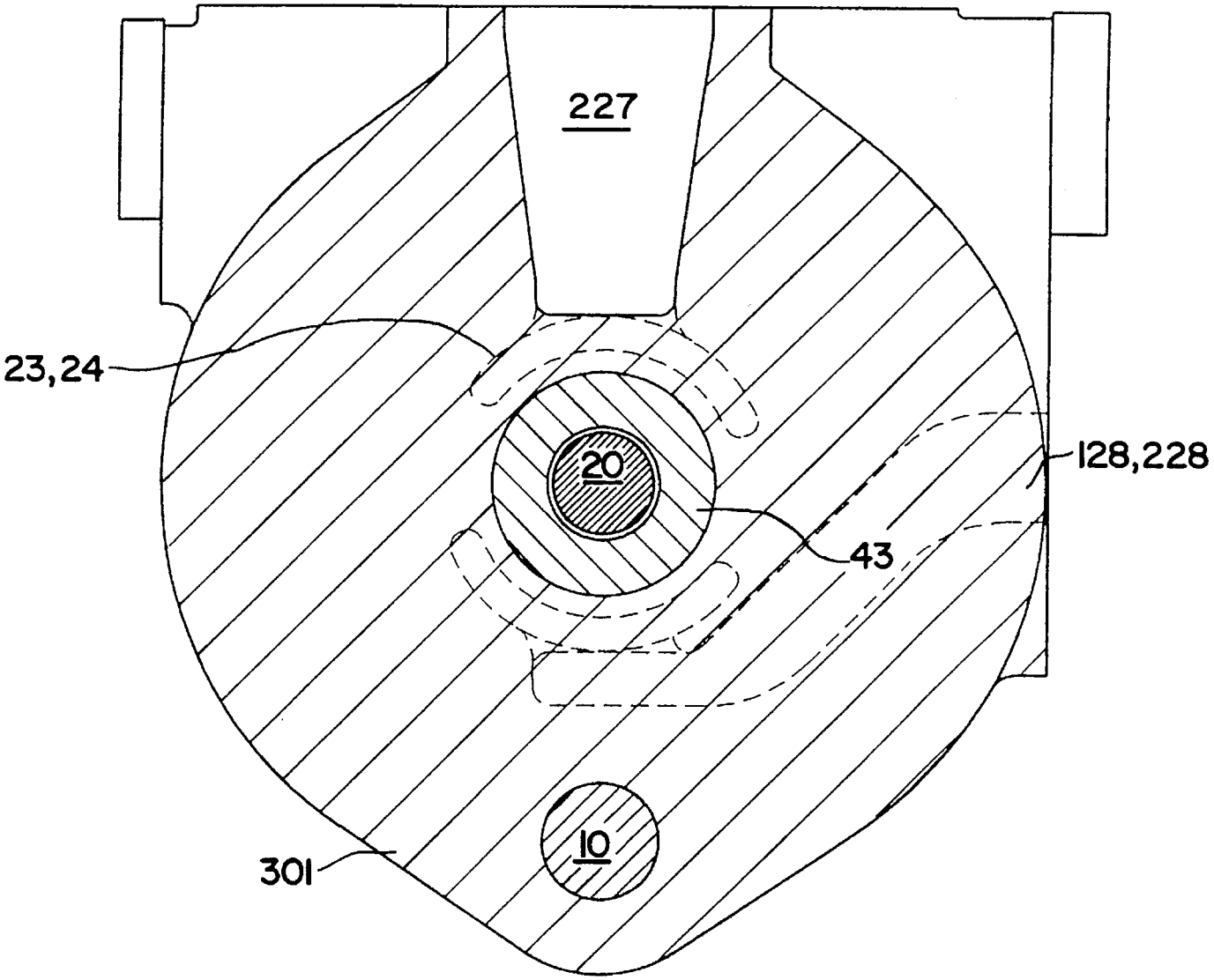
FIG. 9 is a cross-sectional view taken along the line IX—IX of FIG. 7.
Figure 10:
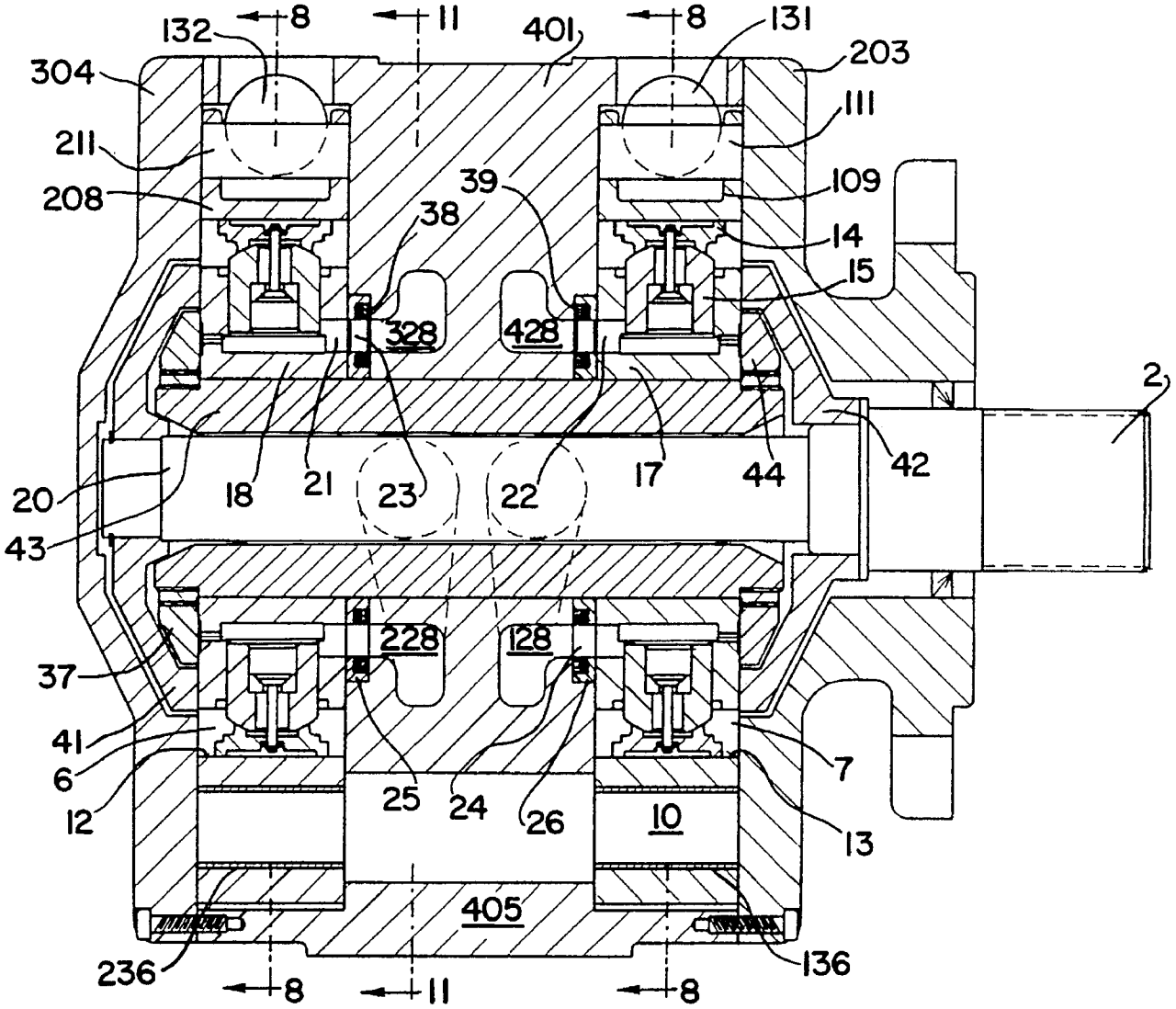
FIG. 10 is a longitudinal sectional view of a fourth embodiment of a hydrostatic engine (double flow pump and double flow motor for different pressures) according to the invention.
Figure 11:
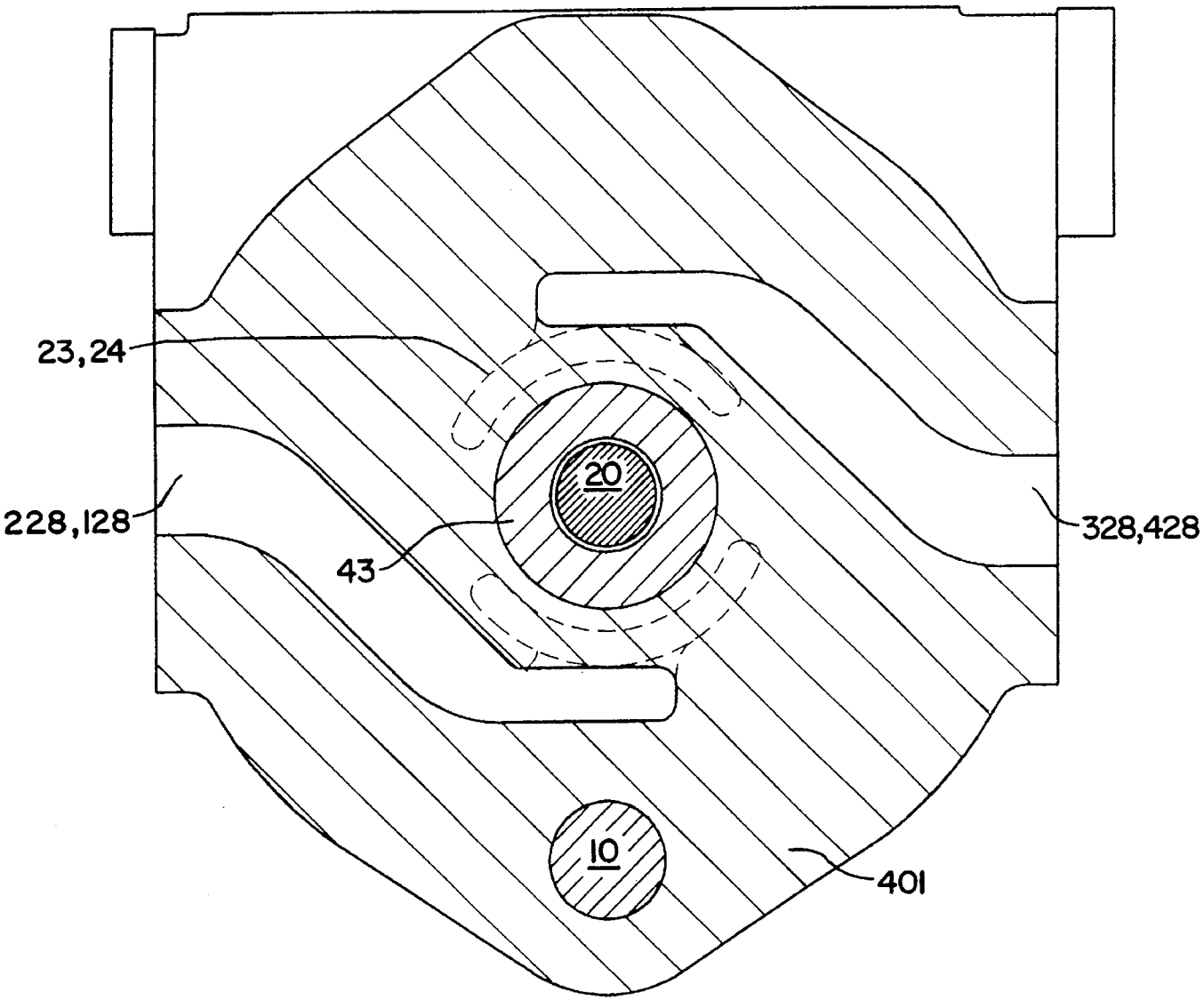
FIG. 11 is a cross-sectional view taken along the line XI—XI of FIG. 10.

According to the invention, all the embodiments shown in FIGS. 1 to 11 of hydrostatic radial piston engines have a housing 1 (FIG. 1), 201 (FIG. 4), 301 (FIG. 7), or 401 (FIG. 10), each of which has two inner chambers separated by an intermediate bottom 5 (FIG. 1), 205 (FIG. 4), 305 (FIG. 7), or 405 (FIG. 10). These inner chambers are closed on both sides thereof and have a housing cover on sides 3, 4 (FIG. 1), 103, 204 (FIG. 4), or 203, 304 (FIGS. 7 and 10). In respective partial (inner) chambers 6, 7, a piston ring 8, 9 (see FIG. 1) or 109, 208 (see FIGS. 4, 7, and 10) is supported. The piston rings are connected to each other by at least one bearing shaft 10.

Figure 3:
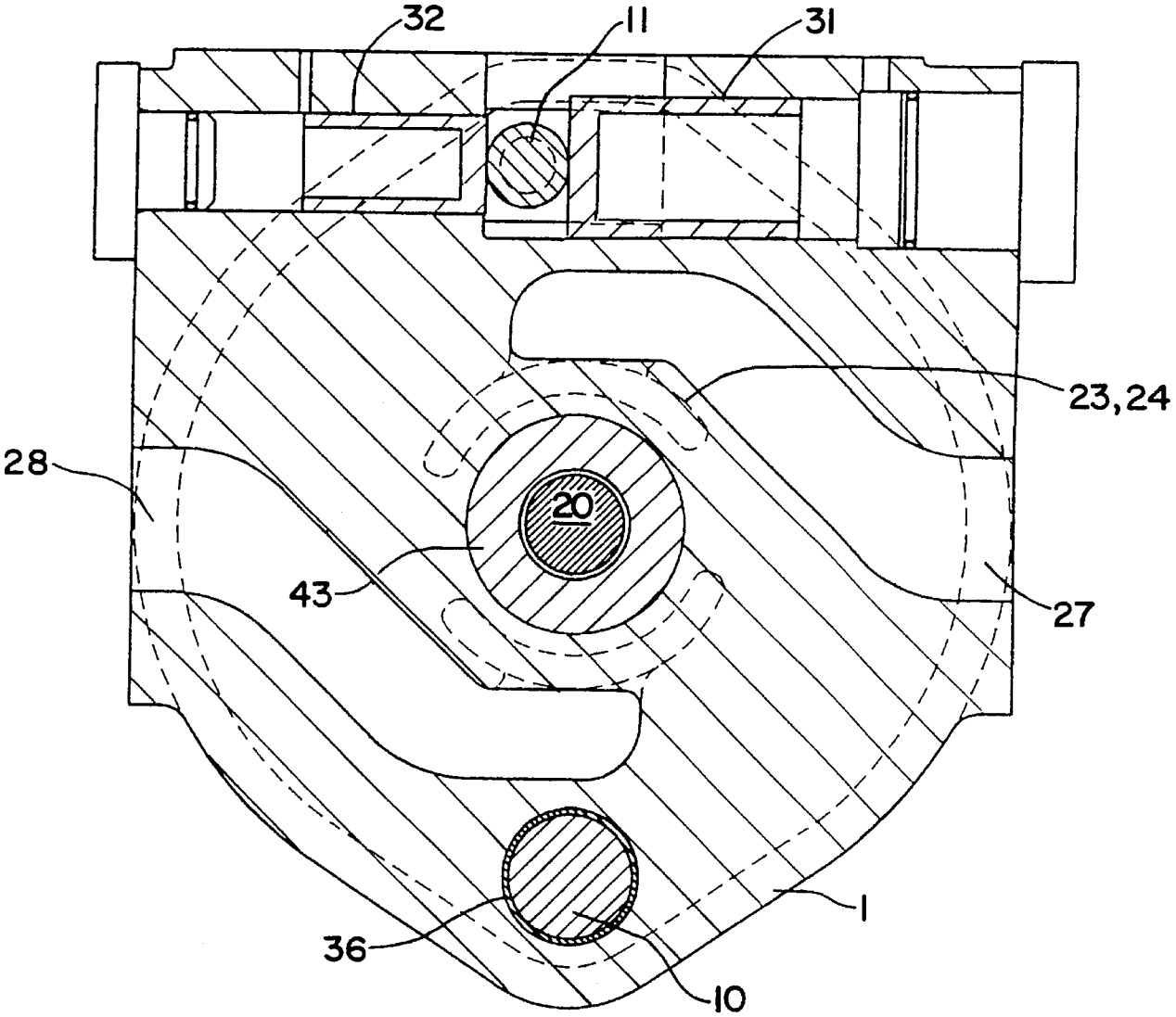
FIG. 3 is a cross-sectional view taken along the line III—III of FIG. 1.

As shown in FIG. 3, the two partial chambers provide sufficient room for the displacement of the piston rings 8, 9 with the aid of two displacement pistons 32, 31 through a connecting shaft 11 and thus adjust the stroke volume per rotation of the hydrostatic radial piston engine to a desired specific magnitude. In the hydrostatic radial piston engines shown in FIGS. 4, 7, and 10, the conjugated piston rings 109, 208 can be displaced independently of each other with the aid of displacement pistons 131, 132, 231, 232 (see reference numbers 111, 211).

The input or output of the engine is done through driving shafts and driven shafts 2, 20 (FIGS. 1, 7, and 10), and 102, 202 (see FIG. 4), respectively, and through a drive carrier 41, 42 to each of rotors 18, 19, forming a cylinder star. Rotors 18, 19 have control slits 21, 22 on a side thereof which correspond to kidney-shaped channels 23, 24 formed in axially-disposed disk cams 25, 26. The axial sealing of the channels 23, 24 in the disk cams 25, 26 is provided with the aid of elastic sealing elements 38, 39.

Radial piston engines according to the invention have an axle 43 which is secured in the respective intermediate bottom 5, 205, 305, or 405 and the rotors 18, 19 are supported on the ends thereof, on the one hand, and between check plates 37, 44 and between disk cams 25, 26, on the other hand.

For each rotor 18, 19, a piston ring 8, 9 (FIG. 1) and 109, 208 (FIG. 4, FIG. 7, FIG. 10), respectively, is provided, both of which are supported in the respective intermediate bottom 5, 205, 305, 405 via a bearing shaft 10.

On an inside 12, 13 of the piston rings 8, 9; 109, 208, respectively, displacement elements slide in a known manner, serving the function or use as a hydrostatic radial piston engine. Each of the displacement elements consists of the functional connection of a slide shoe or a slide ring 14 and a (displacement) piston 15 joined thereto by linking. The pistons 15 are disposed in radial bores 16, 17 in each of rotors 18, 19, which in turn, are supported so that they can rotate easily but are fixed axially, and drive or are driven via a drive carrier 41, 42.

The embodiments described above correspond to the state of the art insofar as the rotors 18, 19 are known, apart from the fact that no data is provided on the transported stream or pumping function thereof. In the embodiments according to the invention described herein however, the hydrostatic radial piston engine is not based on two rotors 18, 19 on a bearing shaft, but on an axle 43 on which the two rotors are supported so they can rotate easily, so that asynchronous operation of the rotors 18, 19 is possible and thus compensating the axial forces on the axle 43.

With regard to a specific function as a pump or a motor element, the rotors 18, 19 are adapted to one another as follows:

As already mentioned, in the radial bores 16, 17 of the rotors 18, 19, there are control slits 21, 22 on the sides thereof, facing one another, through which the bores 16, 17 are open toward the respective intermediate bottoms 5, 205, 305, 405. The control slits 21, 22 correspond to the kidney-shaped channels 23, 24 (see FIGS. 3, 6, 9, and 11) formed in the disk cams (axial disks) 25, 26. The disk cams 25, 26 are placed into the corresponding recesses on both sides of the intermediate bottoms 5, 205, 305, 405. In the intermediate bottoms 5, 205, 305, 405, corresponding to the above mentioned control slits 21, 22 and kidney-shaped channels 23, 24, connecting channels 27, 28 (FIG. 1), 127, 128, 228 (FIG. 4); 127, 128, 228 (FIG. 7); 128, 228, 328, 428 (FIG. 10) are formed, so that the two rotors 18, 19 can work together as a pump or as a hydrostatic engine through the displacement elements thereof.

The axial thrust produced by the application of pressure to the (displacement) piston 15 and the control slits 21, 22 is taken up due to the clamping of the axle 43 in the intermediate bottom 5, 205, 305, 405, between the disk cam 26 resting on the intermediate bottom and the check plate 44, and, respectively, between the disk cam 25 supported on the intermediate bottom 5, 205, 305, 405 and the check plate 37, and thus is not transferred to the housing cover 3, 4; 103, 204; 203, 304. The two check plates 37, 44 are each prestressed against a collar 33, 34 on the axle 43 in such a way that the distance between the check plates and the intermediate bottom and between the disk cams 25, 26, respectively, is somewhat larger than that corresponding to the width of the rotors 18, 19.

The embodiments described herein and the relationship described in connection with them refer first of all to a hydrostatic radial piston engine with two rotors that are supported on an axle so that they can rotate easily, the rotors having a plurality of radial bores with displacement elements sliding on the inside, whereby the bores are connected with transport channels opening on a side of the rotor, through control slits, for the purpose of controlling the transport of a pressure medium.

The displacement volume of the two rotors may be different and also may be changed by a common adjusting device. Furthermore, each of the rotors may have a high-pressure and a low-pressure connection.

When a device according to the invention is utilized for a compact drive in a secondarily controlled design, the high pressure sides of each of the rotors may preferably be connected to each other while the low-pressure sides of the two rotors may be separated.

When a device according to the invention is utilized for pumps or motors with different operating pressures and for motors with different rates of rotation, the low-pressure sides of the two rotors may preferably be connected to each other and the high-pressure sides thereof separated.

Depending on the specific embodiment as a pump, motor or drive, the housing 1, 201, 301, 401 and the housing cover (3, 4); (103, 204); (203, 304), as well as the driving shaft and driven shaft 2, 20; 102, 202 are modified.

Figure 1:
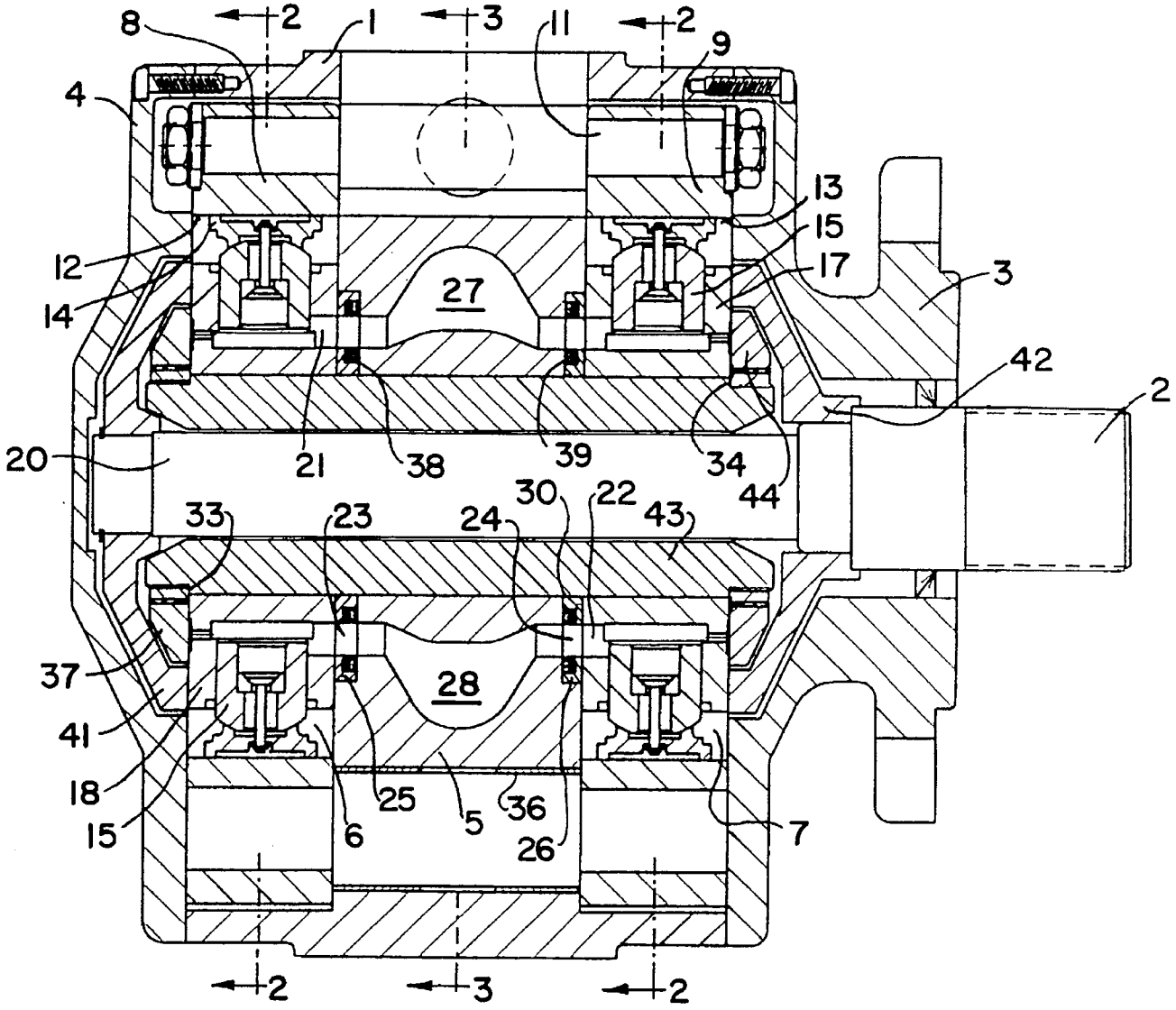
FIG. 1 is a longitudinal sectional view of a hydrostatic engine (pump and motor) according to the invention.
Figure 2:
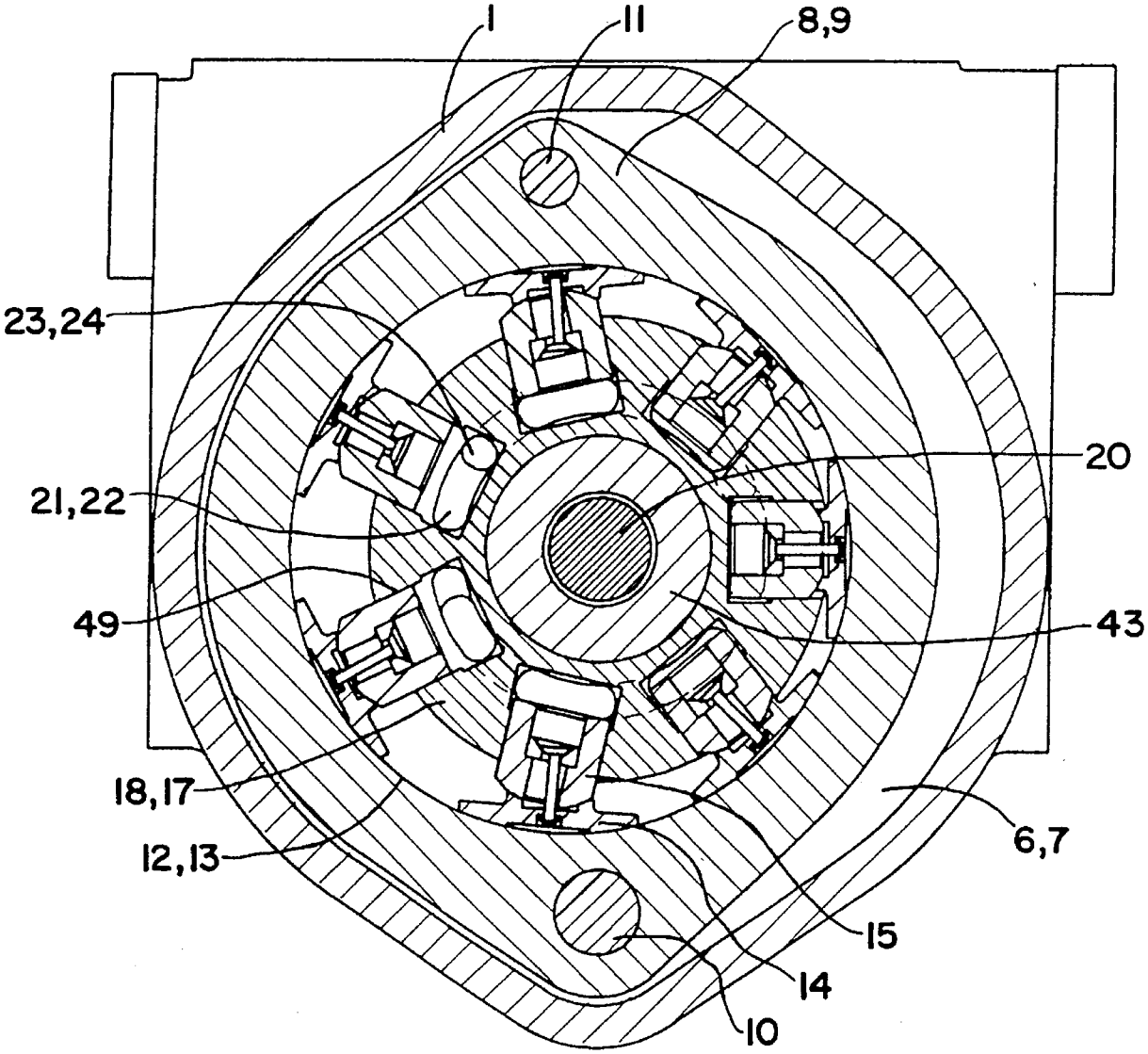
FIG. 2 is a cross-sectional view taken along the line II—II of FIG. 1.
Figure 4:
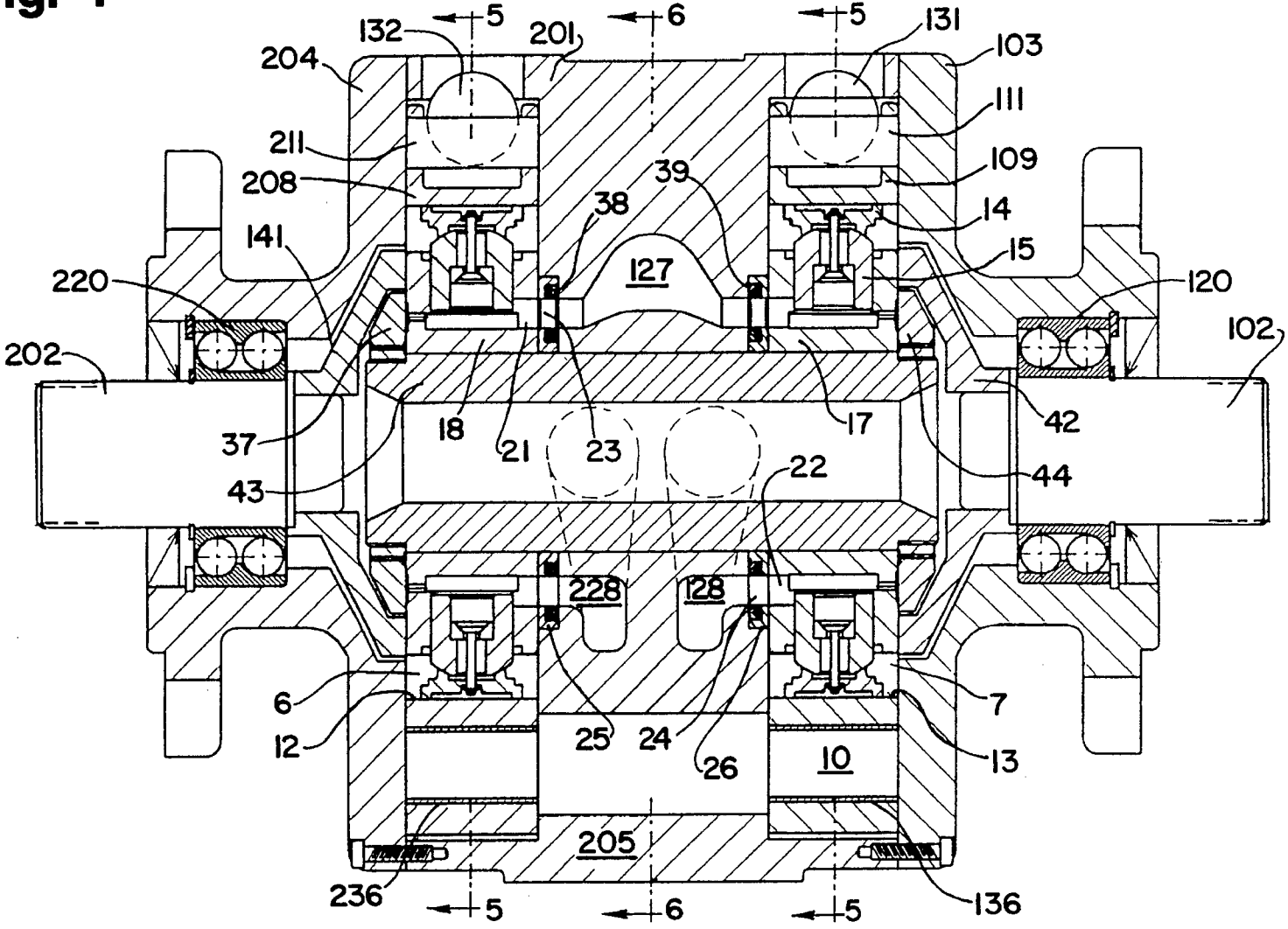
FIG. 4 is a longitudinal sectional view of a second embodiment of a hydrostatic engine (drive) according to the invention.
Figure 5:
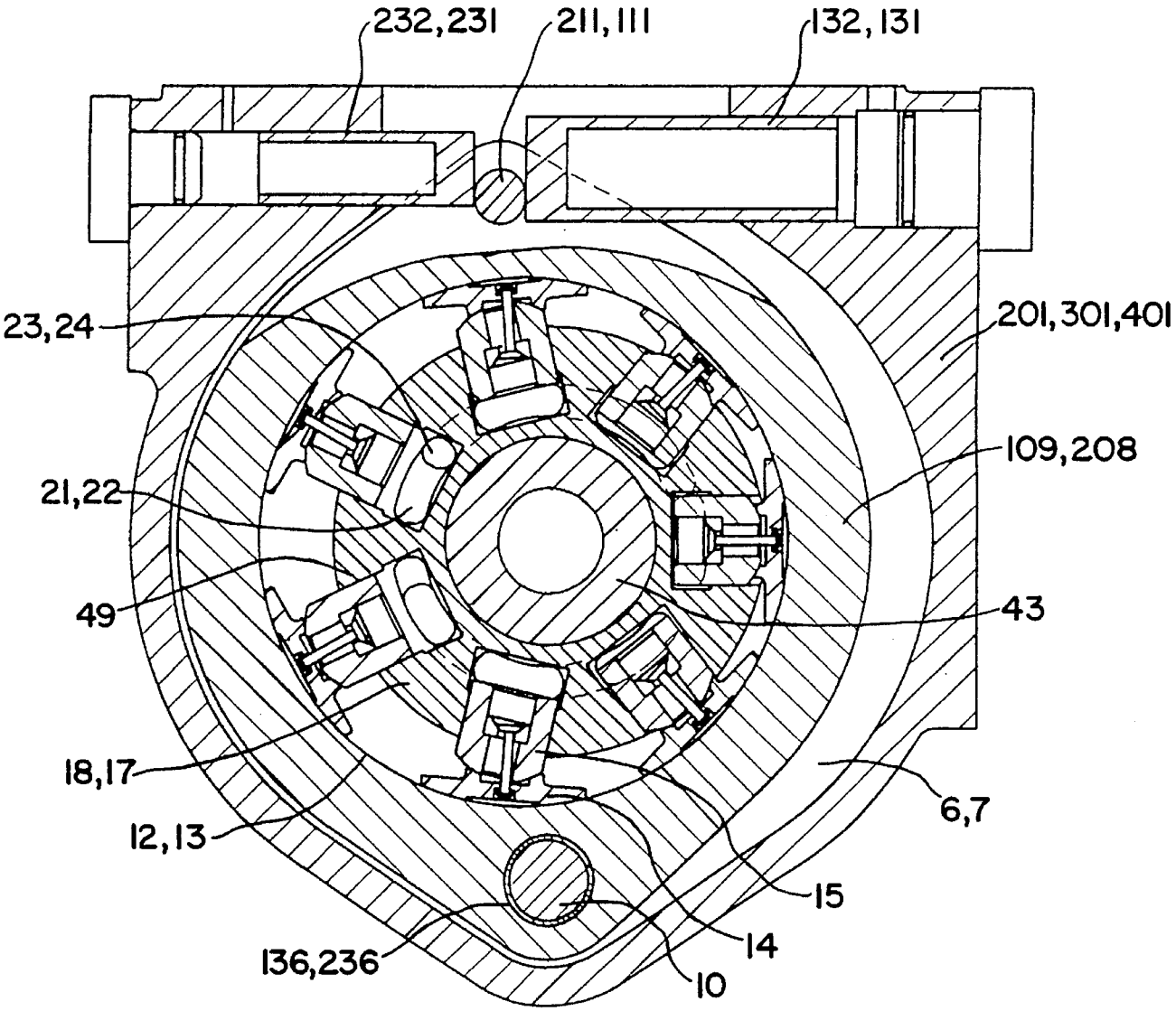
FIG. 5 is a cross-sectional view taken along the line V—V of FIG. 4.
Figure 6:
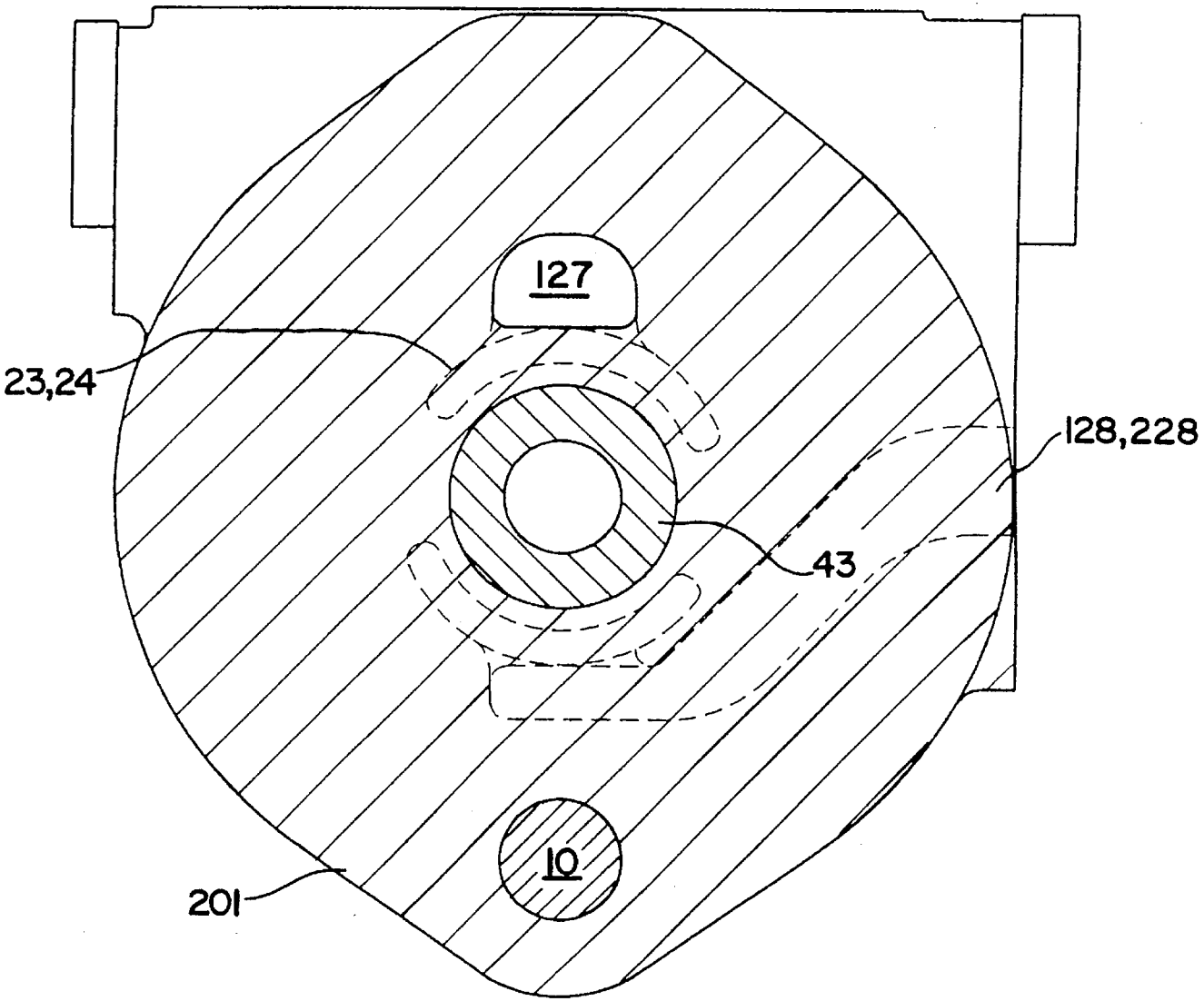
FIG. 6 is a cross-sectional view taken along the line VI—VI of FIG. 4.

Thus, depending on the embodiment, the following are produced:

according to FIG. 1, a hydrostatic pump and a hydrostatic motor, respectively;

a hydrostatic drive according to FIG. 4;

a hydrostatic double-flow pump and a hydrostatic double-flow motor, respectively, according to FIG. 7; and a comparable hydrostatic double-flow pump and hydrostatic double-flow motor according to FIG. 10 for different pressures in channels 128, 228, 328, 428.

The foregoing detailed description is given for clearness of understanding only, and no unnecessary imitations should be understood therefrom, as modifications within the scope of the invention will be apparent to those skilled in the art.

We claim:

1. In a hydrostatic radial piston engine comprising two rotors supported by and readily rotatable on an axle, said rotors having a plurality of radial bores, wherein displacement elements disposed in said bores comprise a piston with a slide ring, each said displacement element sliding on an inside of a piston ring, the bores being connected via control slits with high-pressure/low-pressure transport channels opening on a side of the rotor to control the transport of a pressure medium, the improvement wherein the axle is mounted in an intermediate bottom disposed between the rotors and comprising check plates disposed on ends of the axle, said check plates taking up axial forces produced by a pressure medium in the control slits of the rotors, said piston rings being supported in the intermediate bottom by a common connecting shaft.

2. The improvement of claim 1 further comprising disk cams disposed on both sides of the intermediate bottom and wherein for each rotor, a collar is provided on the axle against which the check plates are placed under tension so that the distance between the check plates and the intermediate bottom and the disk cams, respectively, is larger than the width of the rotors.

3. The improvement of claim 1 wherein each of the two rotors has an adjustable displacement volume controlled by a common adjusting device.

4. The improvement of claim 1 utilized for a compact drive in a secondarily controlled design wherein each rotor has a high-pressure and a low-pressure side and wherein the high pressure sides of the two rotors are connected to each other and low-pressure sides of the two rotors are separated.

5. The improvement of claim 1 utilized for pumps or motors with different operating pressures and for motors with different rates of rotation, wherein each rotor has a high-pressure side and a low-pressure side and wherein the low-pressure sides of the two rotors are connected to each other and the high-pressure sides thereof are separated from each other.

6. The improvement of claim 1 wherein each rotor has a high-pressure connection and a low-pressure connection.

7. The improvement of claim 1 wherein the two rotors have different displacement volumes.

* * * * *